US009699565B2

(12) United States Patent
Cardas

(10) Patent No.: US 9,699,565 B2
(45) Date of Patent: Jul. 4, 2017

(54) LOUDSPEAKER USING CONTOUR FIELD HARD MAGNET POLES AND YOKE CONSTRUCTION

(71) Applicant: Cardas Audio Ltd., Bandon, OR (US)

(72) Inventor: George Francis Cardas, Bandon, OR (US)

( * ) Notice: Subject to any disclaimer, the term of this patent is extended or adjusted under 35 U.S.C. 154(b) by 0 days.

(21) Appl. No.: 14/961,850

(22) Filed: Dec. 7, 2015

(65) Prior Publication Data

US 2016/0165353 A1 Jun. 9, 2016

Related U.S. Application Data

(60) Provisional application No. 62/088,683, filed on Dec. 7, 2014.

(51) Int. Cl.

| | |
|---|---|
| ***H04R 9/02*** | (2006.01) |
| *G10K 9/13* | (2006.01) |
| *H01F 7/02* | (2006.01) |
| *H01F 3/10* | (2006.01) |
| *H01F 1/03* | (2006.01) |

(52) U.S. Cl.

CPC ..... *H04R 9/025* (2013.01); *G10K 9/13* (2013.01); *H01F 1/03* (2013.01); *H01F 3/10* (2013.01); *H01F 7/0289* (2013.01); *H04R 2209/024* (2013.01)

(58) Field of Classification Search

CPC ..... H04R 9/025; H04R 9/027; H04R 9/06; H01F 7/0289; H01F 7/066; H01F 7/021; H01F 13/003; H01F 7/081; H01F 2003/103; H01F 7/1646; H01F 7/0273; H01F 7/02; H01F 7/0205; G10K 9/13

USPC ..... 381/340, 342, 420, 421, 422

See application file for complete search history.

(56) References Cited

U.S. PATENT DOCUMENTS

| | | | | | |
|---|---|---|---|---|---|
| 2,517,727 | A * | 8/1950 | Smith | H04R 9/025 | 381/420 |
| 2,864,155 | A * | 12/1958 | Willson | H04R 9/025 | 29/594 |
| 5,142,260 | A * | 8/1992 | House | H04R 9/025 | 335/222 |
| 5,357,587 | A * | 10/1994 | Grodinsky | H04R 1/403 | 381/414 |
| 5,912,978 | A * | 6/1999 | Eastty | H04R 1/005 | 381/397 |

(Continued)

FOREIGN PATENT DOCUMENTS

| | | | | |
|---|---|---|---|---|
| GB | 1336481 A | * | 11/1973 | H01F 13/003 |
| KR | WO 2010067922 A1 | * | 6/2010 | H04R 9/025 |

*Primary Examiner* — Davetta W Goins
*Assistant Examiner* — Oyesola C Ojo
(74) *Attorney, Agent, or Firm* — Rylander & Associates, PC; Philip R. M. Hunt

(57) ABSTRACT

Several embodiments of the instant invention incorporate a loudspeaker design utilizing hard magnetic poles and yokes. The magnetic field of the loudspeaker is created and guided with a series of critically formed hard magnetic structures guiding the magnetic field from the primary magnet to the gap in a loop of hard magnetic material, replacing the soft magnetic materials normally used. Magnetization of the components of the hard magnetic loudspeaker driver with radial pole patterns—a yoke radial magnet, a washer pole magnet and a yoke upper ring magnet—is performed with these components in their final assembly relationships.

11 Claims, 8 Drawing Sheets

(56) References Cited

U.S. PATENT DOCUMENTS

| | | | | |
|---|---|---|---|---|
| 6,529,107 | B2 * | 3/2003 | Shimizu | H01F 7/0284 335/302 |
| 8,769,803 | B2 * | 7/2014 | Koike | H04R 31/00 29/592.1 |
| 2003/0053651 | A1 * | 3/2003 | Koura | H04R 9/04 381/405 |
| 2006/0050921 | A1 * | 3/2006 | Kaiya | H04R 9/022 381/397 |
| 2006/0165251 | A1 * | 7/2006 | Bank | H04R 9/025 381/414 |
| 2010/0034418 | A1 * | 2/2010 | Bonin | H04R 9/025 381/396 |

* cited by examiner

LOUDSPEAKER USING CONTOUR FIELD HARD MAGNET POLES AND YOKE CONSTRUCTION

CROSS-REFERENCE TO RELATED APPLICATION

This application claims the benefit of U.S. Provisional Application No. 62/088,683, filed Dec. 7, 2014, incorporated herein by reference.

FIELD OF THE INVENTION

The present invention relates to loudspeakers. More particularly, the present invention relates to loudspeakers for ear phones.

BACKGROUND

The performance of dynamic loudspeakers and transducers incorporating moving coil or moving wire in a magnetic field spanning a gap between stationary structures (typically a pole and a yoke) is necessarily limited by the soft magnetic materials (typically iron) used in these stationary structures. Most loudspeakers use a mix of hard and soft magnetic materials to perform the function of guiding a magnetic field from a primary magnet through the gap of the transducer.

In most standard loudspeaker designs, the magnetic flux from a fixed hard magnet or magnets is routed through soft magnetic material used in a pole piece and a yoke. The pole allows the field from the hard magnet to be routed to and focused in the gap between the pole and the yoke where the coil interacts with the field to transduce or convert a varying electrical signal passing through the coil into motion of the coil. The coil is fixed to a diaphragm and movement of the diaphragm produces sound.

The use soft magnetic structures in a loudspeaker creates problems. The varying electrical currents in the transducer coils induce fluctuating magnetic fields in the soft magnetic pole and yoke structures, which can then cause the magnetic field in the gap to fluctuate. This flux modulation causes distortion in the sound produced.

BRIEF DESCRIPTION OF THE DRAWINGS

The present invention will be described by way of exemplary embodiments, but not limitations, illustrated in the accompanying drawings in which like references denote similar elements, and in which.

The accompanying drawings, which are incorporated into and constitute a part of this specification, illustrate one or more embodiments of the invention and, together with the detailed description, serve to explain the principles and implementations of the invention.

DETAILED DESCRIPTION

Before beginning a detailed description of the subject invention, mention of the following is in order. When appropriate, like reference materials and characters are used to designate identical, corresponding, or similar components in different figures. The figures associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Use of directional terms such as "upper," "lower," "above," "below", "in front of," "behind," etc. are intended to describe the positions and/or orientations of various components of the invention relative to one another as shown in the various Figures and are not intended to impose limitations on any position and/or orientation of any embodiment of the invention relative to any reference point external to the reference.

Those skilled in the art will recognize that numerous modifications and changes may be made to the exemplary embodiment(s) without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the exemplary embodiment(s) is essential. Other embodiments are possible, their specific designs depending upon the particular application. As such, the scope of the invention should not be limited by the particular embodiments herein described but should be defined only by the appended claims and equivalents thereof.

Exemplary Embodiment

Figure 1A:
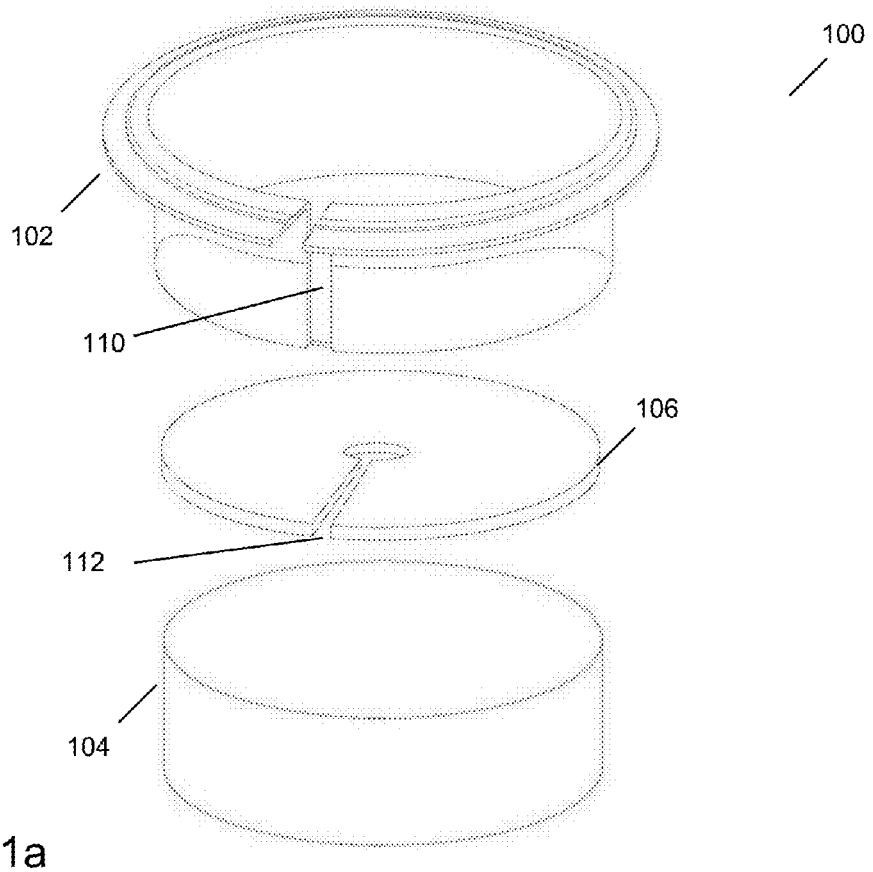
FIG. 1A shows an exploded view of an exemplary embodiment of a loudspeaker driver assembly.
Figure 1B:
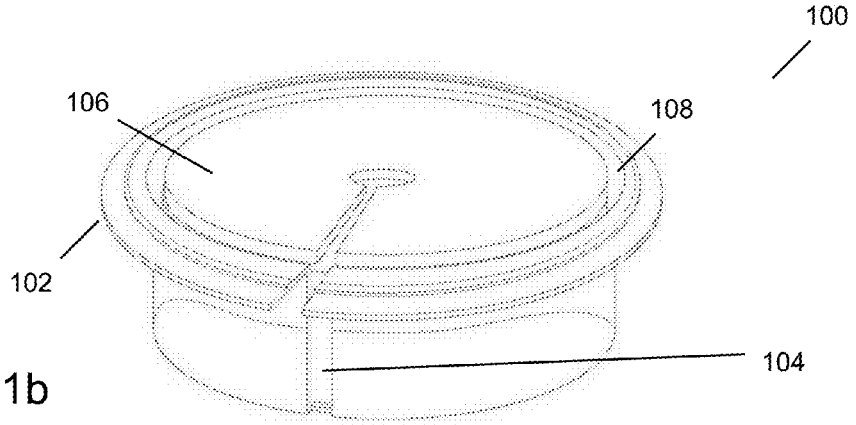
FIG. 1B shows a perspective view of the loudspeaker driver assembly.

FIG. 1A shows an exploded view of an exemplary embodiment of a hard magnetic loudspeaker driver 100 and FIG. 1B shows a perspective view of the hard magnetic loudspeaker driver 100. The hard magnetic loudspeaker driver 100 comprises a yoke 102, a center pole 104, and a washer pole magnet 106. The center pole 104 is configured to nest within the yoke 102 and the washer pole magnet 106 is configured to nest within the yoke 102 on top of the center pole 104. The yoke 102 and washer pole magnet 106 are sized, shaped, and positioned such that a pole-yoke gap 108 exists between them.

Figure 2A:
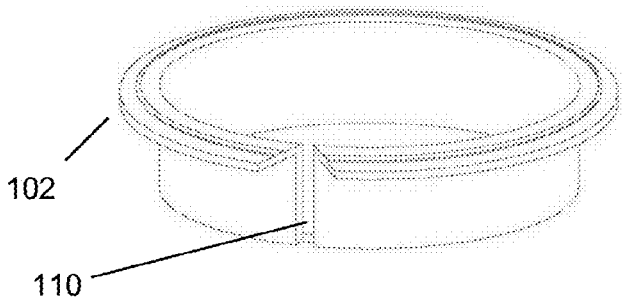
FIG. 2A shows a perspective view of the yoke.
Figure 2B:
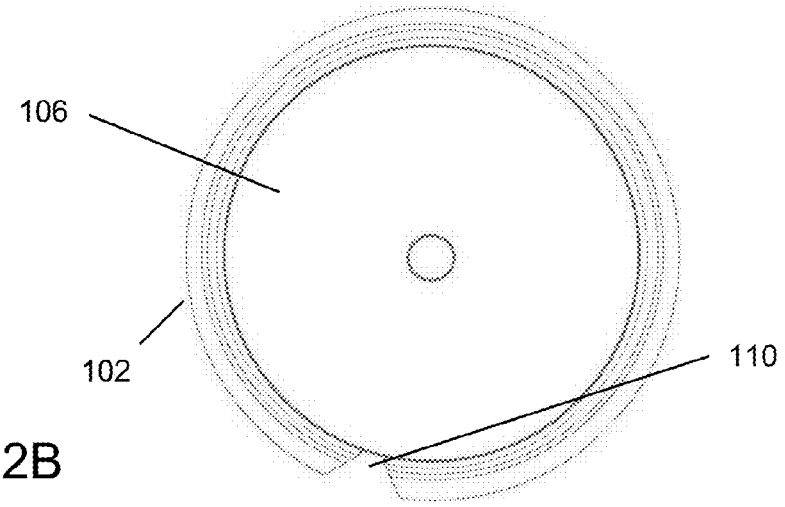
FIG. 2B shows a top plan view of the yoke.
Figure 2C:
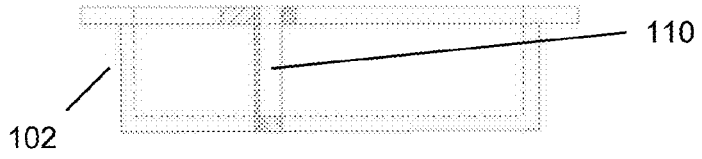
FIG. 2C shows a side cut-away view of the yoke.
Figure 5A:
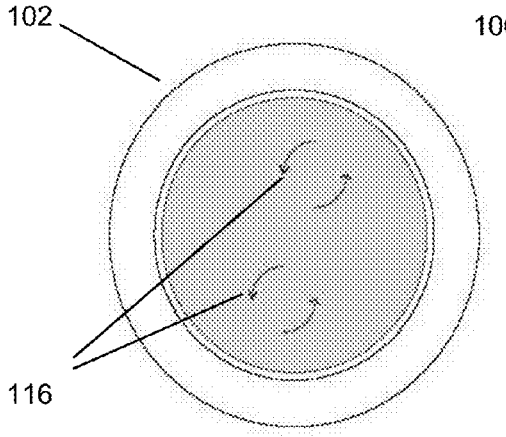
FIGS. 5*a* and 5*b* illustrate eddy current generation and mitigation.
Figure 5B:
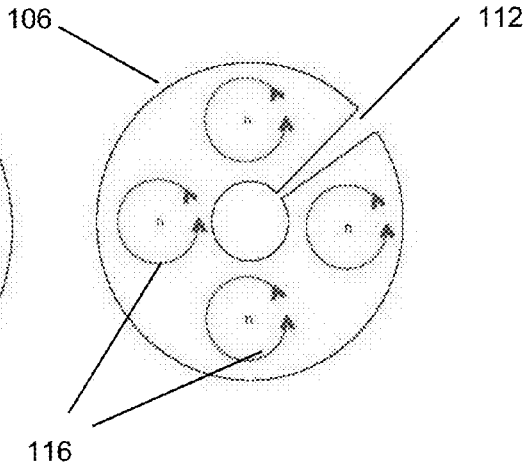

FIG. 2A shows a perspective view of the yoke 102. FIG. 2B shows a top plan view of the yoke 102. FIG. 2C shows a side cut-away view of the yoke 102. The yoke 102 has a yoke gap 110 in one side to prevent large-scale eddy currents from occurring. The washer pole magnet 106 has a washer gap 112 that serves the same purpose. FIGS. 5*a* and 5*b* illustrate eddy current 116 generation and mitigation. In the embodiment of FIG. 5*a*, the yoke 102 does not have a yoke gap 110. Eddy currents 116 induced into the yoke 102 can combine into a large net eddy current 116 around the yoke 102. In FIG. 5*b*, the washer pole magnet 106 has a washer gap 112 that prevents the eddy currents 116 induced into the washer pole magnet 106 from combining into a large net eddy current 116.

Figure 3:
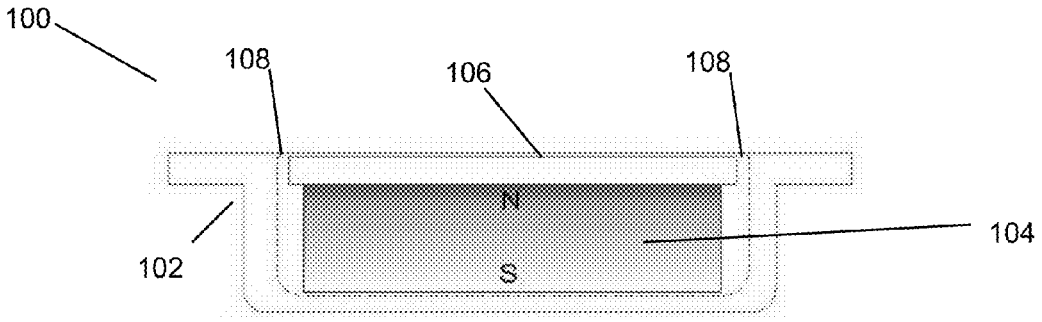
FIG. 3 shows a cut-away side view of the loudspeaker driver assembly.
Figure 4:
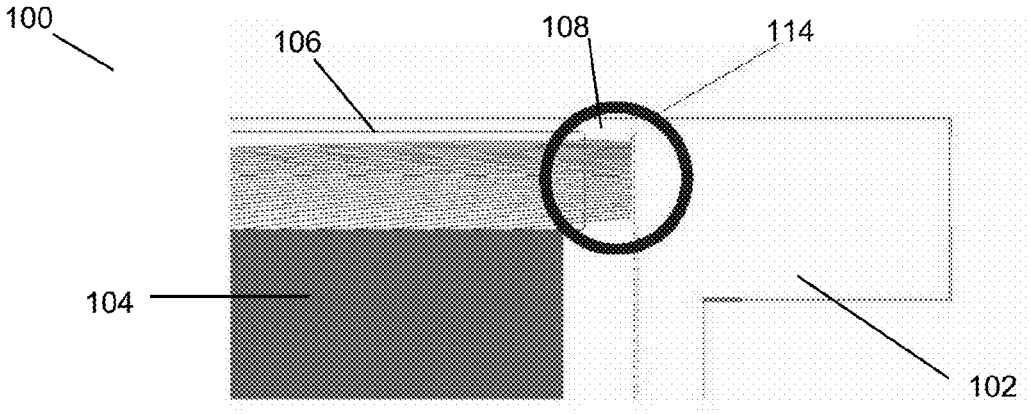
FIG. 4 shows a close-up of the pole-yoke gap in FIG. 3, showing magnetic lines of force in the pole-yoke gap.

FIG. 3 shows a cut-away side view of the hard magnetic loudspeaker driver 100. FIG. 4 shows a close-up of the pole-yoke gap 108 in FIG. 3, showing magnetic lines of force 114 in the pole-yoke gap 108. A voice coil 140 (see FIG. 6A) is configured to enter the pole-yoke gap 108 when current passing the through the voice coil 140 induces a magnetic field in the voice coil 140 that interacts with the magnetic lines of force 114 and draws the voice coil 140 to enter the pole-yoke gap 108. The voice coil 140 moves according to signal variations in the current it is carrying, moving the speaker diaphragm 142, which generates sound.

In prior art embodiments, the center pole 104 comprises hard magnetic material (material that is difficult to magnetize, but once magnetized, is difficult to demagnetize) and the yoke 102 and washer pole magnet 106 comprise soft magnetic material (material that can be easily magnetized at low magnetic field). Since soft magnetic materials can be demagnetized at low magnetic field, coercivity $H_c$ is low. As they can be easily magnetized, their permeability is high. Hard magnetic materials require a higher magnetic field to magnetize and have coercivity He that is usually high. The yoke 102 and the washer pole magnet 106 are shaped to focus the magnetic circuit that originates in center pole 104 into the pole-yoke gap 108. This focused field is presumed to be stable—but in reality it is modulated by the signals reflection in the soft material of the yoke 102 and washer pole magnet 106. This results in flux modulation distortion. Eddy currents 116 from a signal in the voice coil 140 can produce persistent phantom or sub poles in the soft magnetic materials used in the yoke 102, and washer pole magnet 106. Their relative strength and persistence is the product of magnetic, susceptibility, permeability and remanence.

The first exemplary embodiment of the hard magnetic loudspeaker driver 100 uses hard magnetic material for some or all parts of the yoke 102 and washer pole magnet 106. Hard magnets lack magnetic susceptibly and are not permeable thus they are stable poles once they are orientated and charged. Substituting uniquely formed magnetic axis aligned hard magnets for the normally used soft magnetic materials substantially eliminates flux modulation distortion. Uniquely constructed hard magnetic yoke 102 and washer pole magnet 106 are formed and charged to form a controlled axis pathway for magnetic lines of force 114 that are used in several ways to replace soft magnetic, high permeability pole materials (such as Iron or silicon steel).

The use of hard magnetic yoke 102 and washer pole magnet 106 components increases linearity of the loudspeaker motor dramatically reduces flux modulation and phase distortion. The reduction of these factors makes the hard magnetic loudspeaker driver 100 utilizing this technology uniquely suited for in ear monitors (IEMS), hearing aids or other applications that require a low distortion linear broadband transducer.

Figure 6A:
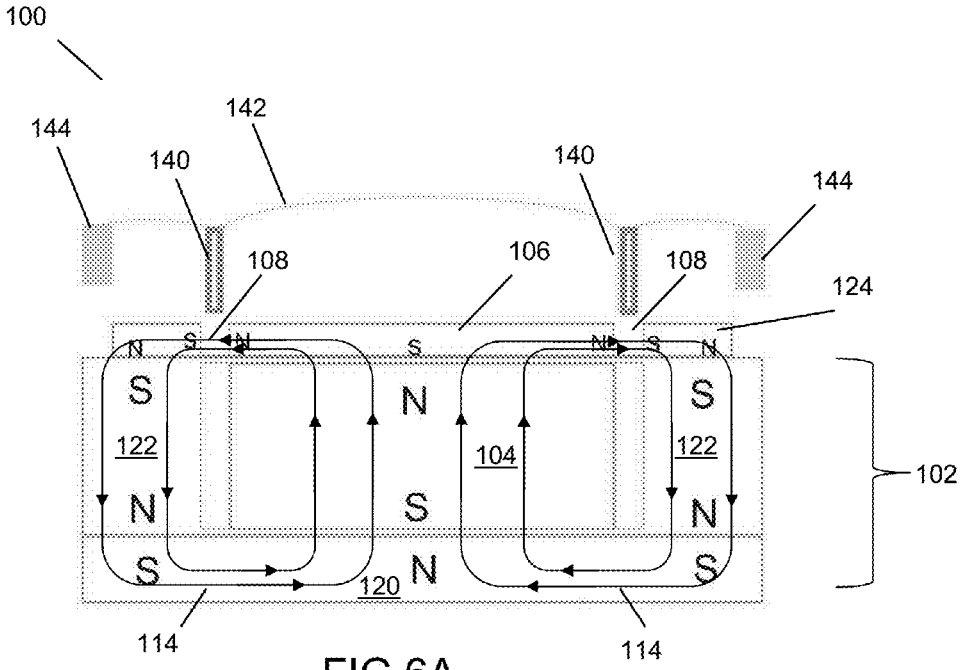
FIG. 6A shows a cut-away view of the loudspeaker driver assembly and pole patterns of the magnets used.
Figure 6B:
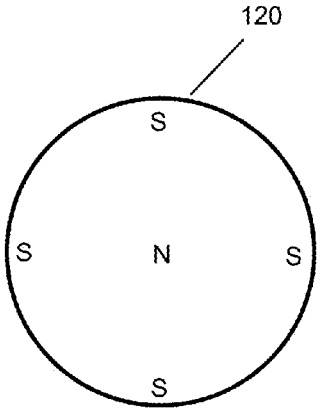
FIG. 6B shows an overhead view of the yoke radial magnet.
Figure 6C:
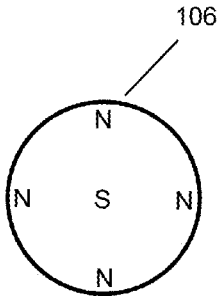
FIG. 6C shows an overhead view of washer pole magnet.
Figure 6D:
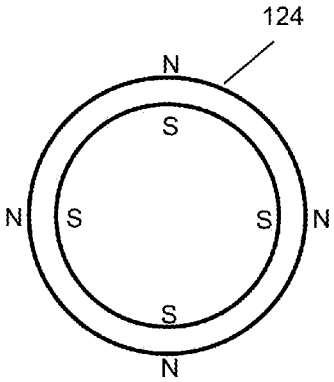
FIG. 6D shows an overhead view of the yoke upper ring magnet.

FIG. 6A shows a cut-away view of the hard magnetic loudspeaker driver 100 and pole patterns of the magnets used. The hard magnetic loudspeaker driver 100 a voice coil 140 attached to a speaker diaphragm 142, which is attached to a diaphragm retainer 144. The voice coil 140 is positioned directly over the pole-yoke gap 108 and configured to enter within when drawn in by currents within the voice coil 140 generating magnetic fields that interact with those in the pole-yoke gap 108. The yoke 102 comprises a yoke radial magnet 120, a yoke lower ring magnet 122 and a yoke upper ring magnet 124. In FIG. 6A these three components of the containment structure yoke 102 are separate components, but in some embodiments, the yoke 102 is a single monolithic part and these three components are conceptual parts of the yoke 102. The yoke radial magnet 120 has a pole pattern with a north pole in the center and a south pole on the circumference. The yoke lower ring magnet 122 has a pole pattern with a north pole facing the south pole of the yoke radial magnet 120 and a south pole at the upper end near the yoke upper ring magnet 124. The yoke upper ring magnet 124 has a pole pattern with a north pole on the outer circumference and a south pole on the inner circumference. The washer pole magnet 106 has a pole pattern with a south pole in the center and a north pole around the circumference. These patterns are illustrated in FIG. 6B, which shows an overhead view of the yoke radial magnet 120, in FIG. 6C, which shows an overhead view of washer pole magnet 106 and in FIG. 6D, which shows an overhead view of the a yoke upper ring magnet 124. In other embodiments, the magnets of the hard magnetic loudspeaker driver 100 could have exactly opposite polarities. For example, the washer pole magnet 106 could have a pole pattern with a north pole in the center and a south pole at the circumference, with the yoke radial magnet 120, yoke lower ring magnet 122, and yoke upper ring magnet 124 having reversed polarities as well.

In alternative embodiments, some, but not all of the yoke radial magnet 120, yoke lower ring magnet 122, and yoke upper ring magnet 124, and washer pole magnet 106 are of hard magnetic materials and the remainder are comprised of soft magnetic materials.

First Exemplary Method of Fabrication

Figure 7:
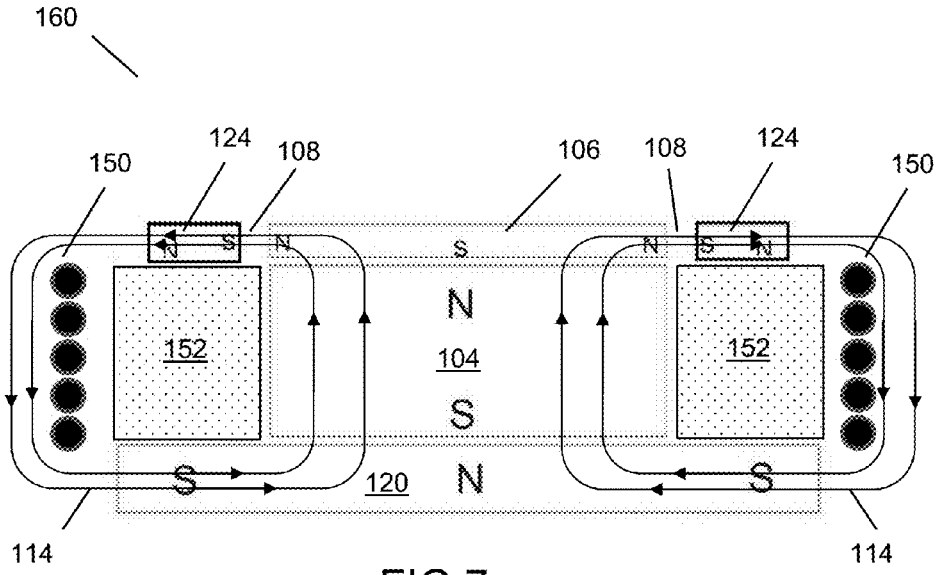
FIG. 7 shows a section view of a first fabrication set-up for fabricating the exemplary hard magnetic loudspeaker driver according to a first exemplary method of fabrication.

FIG. 7 shows a section view of a first fabrication set-up 160 for fabricating the exemplary hard magnetic loudspeaker driver 100 according to a first exemplary method of fabrication. The center pole 104, the yoke radial magnet 120, the washer pole magnet 106 and the yoke upper ring magnet 124 are made from hard magnetic material in their designed shapes, using known manufacturing techniques such as sintering or casting. These component are initially made without imparting any magnetization to them. These components are made separately and then assembled in the first fabrication set-up 160 as shown in FIG. 7 with a non-magnetic yoke lower ring 152 substituted for the yoke lower ring magnet 122. A magnetization coil 150 is placed around the non-magnetic yoke lower ring 152. Current is passed through the magnetization coil 150, magnetizing the center pole 104, the yoke radial magnet 120, the washer pole magnet 106 and the yoke upper ring magnet 124. The direction of the current determines the orientation of the poles in these components. These components are then removed from the magnetization coil 150 and the yoke lower ring magnet 122 placed inside the magnetization coil 150. Current is then passed through the magnetization coil 150 in an opposite direction from the current used in magnetizing the other components of the hard magnetic loudspeaker driver 100. The yoke lower ring magnet 122 is then removed from the magnetization coil 150. Now magnetized with substantial residual magnetism, the components of the hard magnetic loudspeaker driver 100 are assembled as described and shown in FIG. 6A.

Hard magnetic materials that may be used include alnico alloys, alloys of neodymium (such as $Nd_2Fe_{14}B$) and alloys of strontium. If the materials used are anisotropic, the center pole 104, the washer pole magnet 106 and the yoke radial magnet 120 should be fabricated with the hard magnetic properties oriented in radial directions and soft magnetic properties oriented circumferentially and along cylindrical axes.

In some alternative embodiments, the center pole 104 may be fabricated and magnetized separately to achieve a customized level of magnetization. In such embodiments, the center pole 104 may be substituted with a soft magnetic pole during the magnetization of the washer pole magnet 106, the yoke radial magnet 120, and the yoke upper ring magnet 124. After all these components are magnetized, the center pole 104 is assembled with the other components of the hard magnetic loudspeaker driver 100.

Second Exemplary Method of Fabrication

Figure 8:
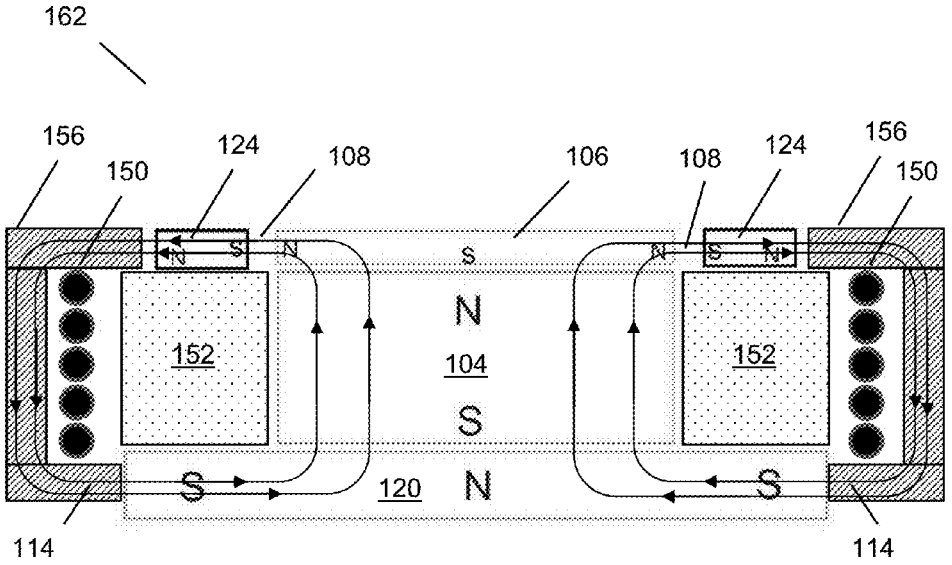
FIG. 8 shows a section view of a second fabrication set-up for fabricating the exemplary hard magnetic loudspeaker driver according to a second exemplary method of fabrication.

FIG. 8 shows a section view of a second fabrication set-up 162 for fabricating the exemplary hard magnetic loudspeaker driver 100 according to a second exemplary method of fabrication. The second method of fabrication is similar to the first method of fabrication, differing only in the fabrication set-ups used. The second fabrication set-up 162 is similar to the first fabrication set-up 160, the primary difference being the placement of a soft magnetic collar 156 around the magnetization coil 150 and configured to provide a path for magnetic lines of force 114 from the yoke upper ring magnet 124 to the yoke radial magnet 120 during magnetization. With the soft magnetic collar 156, better magnetization and pole patterns can be created in the yoke upper ring magnet 124 and yoke radial magnet 120. Also, less energy is required for the same amount of magnetization. The same soft magnetic collar 156 may be used for magnetization of the yoke lower ring magnet 122, or a different soft magnetic collar may be used with different geometries to provide better magnetization and pole patterns for the yoke lower ring magnet 122.

Third Exemplary Method of Fabrication

Figure 9:
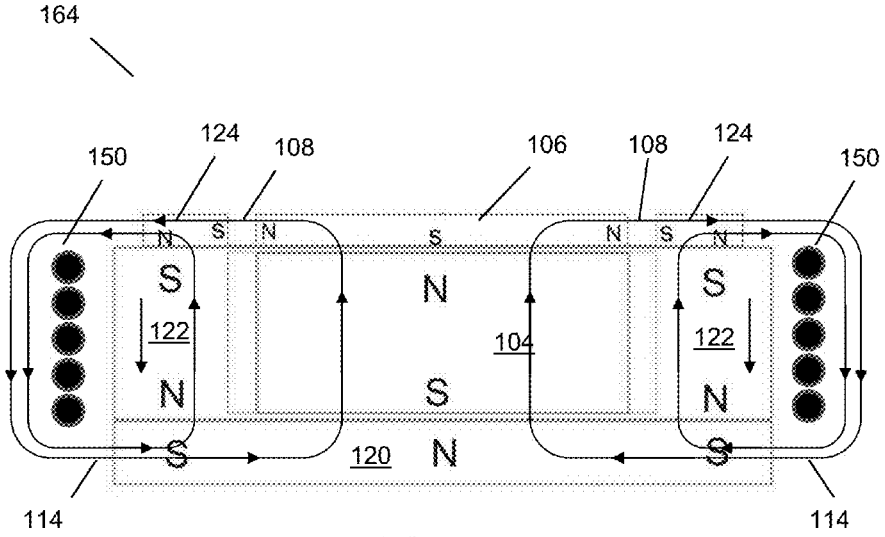
FIG. 9 shows a section view of a third fabrication set-up for fabricating the exemplary hard magnetic loudspeaker driver according to a third exemplary method of fabrication.

FIG. 9 shows a section view of a third fabrication set-up 162 for fabricating the exemplary hard magnetic loudspeaker driver 100 according to a third exemplary method of fabrication. The third method of fabrication is similar to the first method of fabrication, with some differences in the fabrication set-up and the methodology as follows.

As in the first fabrication set-up 160, the third fabrication set-up 164 has a magnetization coil 150. In some embodiments, soft magnetic collar 156 may be included the third fabrication set-up 164 and used in a similar manner as in the second exemplary method of fabrication, but in other embodiments, no soft magnetic collar 156 is used, as in the first exemplary method.

As in the first exemplary method, the center pole 104, the yoke radial magnet 120, the washer pole magnet 106 and the yoke upper ring magnet 124 are made from hard magnetic material in their designed shapes, using known manufacturing techniques such as sintering or casting. At least the yoke radial magnet 120, the washer pole magnet 106 and the yoke upper ring magnet 124 are initially made without imparting any magnetization to them. However, unlike in the first exemplary method, here the yoke lower ring magnet 122 is magnetized separately. These components are then assembled as in the third fabrication set-up 164 as shown in FIG. 9. However, unlike the first fabrication set-up 160, no non-magnetic yoke lower ring 152 is substituted for the yoke lower ring magnet 122. The magnetization coil 150 is placed around the yoke lower ring magnet 122. Current is passed through the magnetization coil 150, magnetizing the center pole 104, the yoke radial magnet 120, the washer pole magnet 106 and the yoke upper ring magnet 124. The magnetic lines of force 114 will pass through the yoke lower ring magnet 122 in a direct opposite the magnetization of the yoke lower ring magnet 122. This could potentially reverse the polarity of magnetization of the yoke lower ring magnet 122, which would not be desirable. However, if the current in the coils is kept below a level calculated to keep the magnetic field intensity below the coercivity $H_c$, the yoke lower ring magnet 122 should maintain its original polarity and most of its previous residual magnetism. The third exemplary method then has a disadvantage over the other two in that the magnetization of the components will probably not be as strong. However, the third exemplary method has the advantages of simplicity and that the magnetization of the components of the hard magnetic loudspeaker driver 100 with radial pole patterns—the yoke radial magnet 120, the washer pole magnet 106 and the yoke upper ring magnet 124—is performed with all the yoke 102 and center pole 104 components in their final assembly. This will likely make a better alignment of pole patterns between the various components than if they were magnetized separately.

What is claimed is:

1. A loudspeaker driver assembly for an in-ear monitor comprising:

a yoke with a center cavity;

wherein the yoke comprises an upper ring piece positioned over a lower ring piece, the lower ring piece positioned over a yoke bottom portion, wherein the upper ring piece, the lower ring piece and the yoke bottom portion comprise hard magnetic material, wherein the yoke bottom portion has a center of the yoke bottom portion having a first polarity and outer edges of the yoke bottom portion having a second polarity, a center pole piece comprising hard magnetic material;

a washer pole piece positioned on top of the center pole piece, wherein the washer pole piece is a radial contour field hard magnet that produces magnetic lines of force that curve between a bottom portion of the washer pole piece and an outer edge portion of the washer pole piece;

wherein the washer pole piece having a center of the second polarity and an outer edge with the first polarity; and wherein the center pole piece and the washer pole piece are positioned within the center cavity of the yoke with a pole-yoke gap between a side of the yoke and the outer edge portion of the washer pole piece.

2. The loudspeaker driver assembly of claim 1, wherein the yoke has a side wall with a yoke gap.

3. The loudspeaker driver assembly of claim 1, wherein the yoke and the center pole piece consist of hard magnetic material.

4. The loudspeaker driver assembly of claim 1, wherein the yoke bottom portion is a radial contour field hard magnet that produces magnetic lines of force that curve between a top outer portion of the yoke bottom portion underneath the lower ring piece and a top center portion of the yoke bottom portion underneath the center pole piece.

5. The loudspeaker driver assembly of claim 1, wherein the washer pole piece has a washer gap extending radially from an outer edge of the washer pole piece to a center of the washer pole piece.

6. The loudspeaker driver assembly of claim 1, wherein the loudspeaker driver assembly is suitable for an in-ear monitor.

7. A method of fabrication for a hard magnetic loudspeaker driver assembly, comprising the steps of:

placing a washer pole piece on top of a center pole piece;

placing the washer pole piece and center pole piece inside a center cavity of a yoke;

wherein the yoke, the center pole piece and the washer pole piece comprise hard magnetic material that is initially unmagnetized;

wherein the yoke comprises an upper ring piece, a lower ring piece, and a yoke bottom portion, with the upper ring piece positioned over the lower ring piece, the lower ring piece positioned over a yoke bottom portion;

wherein the upper ring piece and the yoke bottom portion comprise hard magnetic material;

wherein prior to magnetization of the yoke, the lower ring piece consists of non-magnetic material;

placing a magnetization coil around the yoke; and passing current through the magnetization coil, magnetizing the yoke, the center pole piece, and the washer pole piece.

8. The method of claim 7, further comprising the steps of:

after magnetizing the yoke, replacing the lower ring piece of non-magnetic material in the yoke with a lower ring piece comprising hard magnetic material that has been magnetized.

9. The method of claim 7, further comprising the steps of:

after magnetizing the yoke, removing the yoke, center pole piece and washer pole piece from the magnetization coil;

placing a lower ring piece comprising hard magnetic material in the magnetization coil;

passing current through the magnetization coil in the opposite direction from a direction of the current when the yoke was magnetized, magnetizing the lower ring piece comprising hard magnetic material; and replacing the lower ring piece of non-magnetic material in the yoke with the lower ring piece comprising hard magnetic material that has been magnetized.

10. The method of claim 7, further comprising the steps of:

prior to magnetizing the yoke, placing a collar comprising soft magnetic material around the magnetization coil, the collar configured to provide a path for magnetic lines of force from the upper ring piece, through the collar, to the yoke bottom portion while magnetizing the yoke.

11. A method of fabrication for a hard magnetic loudspeaker driver assembly, comprising the steps of:

placing a washer pole piece on top of a center pole piece;

placing the washer pole piece and center pole piece inside a center cavity of a yoke;

wherein the yoke, the center pole piece and the washer pole piece comprise hard magnetic material that is initially unmagnetized;

wherein the yoke comprises an upper ring piece, a lower ring piece, and a yoke bottom portion, one or more of which comprise hard magnetic material, with the upper ring piece positioned over a lower ring piece, the lower ring piece positioned over a yoke bottom portion;

placing a magnetization coil around the yoke;

prior to magnetizing the yoke, placing a collar comprising soft magnetic material around the magnetization coil, the collar configured to provide a path for magnetic lines of force from the upper ring piece, through the collar, to the yoke bottom portion while magnetizing the yoke; and passing current through the magnetization coil, magnetizing the yoke, the center pole piece, and the washer pole piece.

* * * * *